US011351779B2

(12) United States Patent
Nagai

(10) Patent No.: US 11,351,779 B2
(45) Date of Patent: Jun. 7, 2022

(54) LIQUID EJECTION HEAD

(71) Applicant: CANON KABUSHIKI KAISHA, Tokyo (JP)

(72) Inventor: Masataka Nagai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/039,621

(22) Filed: Sep. 30, 2020

(65) Prior Publication Data

US 2021/0094295 A1 Apr. 1, 2021

(30) Foreign Application Priority Data

Oct. 1, 2019 (JP) ..... JP2019-181239

(51) Int. Cl.
*B41J 2/14* (2006.01)

(52) U.S. Cl.
CPC ..... *B41J 2/1404* (2013.01); *B41J 2/1433* (2013.01); *B41J 2/14088* (2013.01); *B41J 2002/14475* (2013.01); *B41J 2202/12* (2013.01)

(58) Field of Classification Search
CPC ..... B41J 2/1404; B41J 2/1433; B41J 2002/14475; B41J 2202/12; B41J 2/14088
See application file for complete search history.

(56) References Cited

U.S. PATENT DOCUMENTS 6,244,694 B1 * 6/2001 Weber ..... B41J 2/055 347/65
9,090,084 B2 7/2015 Govyadinov et al.

* cited by examiner

*Primary Examiner* — Geoffrey S Mruk
(74) *Attorney, Agent, or Firm* — Canon U.S.A., Inc. I.P. Division

(57) ABSTRACT

A liquid ejection head includes an ejection orifice forming member having a liquid ejection orifice and a substrate having a liquid flow path such that a liquid circulation flow path is formed between the ejection orifice forming member and the substrate. The liquid circulation flow path includes a bubble generation chamber facing the liquid ejection orifice and is branched from the liquid flow path so as to pass through the bubble generation chamber and join the liquid flow path. The substrate has an ejection energy generation element arranged to face the bubble generation chamber and a circulation energy generation element arranged at a different position to face the liquid circulation flow path. The gap between the ejection energy generation element and the ejection orifice forming member is different from the gap between the circulation energy generation element and the ejection orifice forming member.

20 Claims, 12 Drawing Sheets

LIQUID EJECTION HEAD

BACKGROUND

Field of the Disclosure

The present disclosure generally relates to a liquid ejection head.

Description of the Related Art

A large variety of products that are categorized as liquid ejection apparatus are being marketed in order to accommodate a broad scope of application of such apparatus and the prioritized aspects of performance of an apparatus of the category under consideration may vary as a function of the intended use of the apparatus. In the instance of a liquid ejection apparatus provided mainly for business use, for example, priority may be given to durability in addition to printing speed and fineness of printed images. For liquid ejection apparatus, a high durability means that the performance of the apparatus is not recognizably degraded after a continuous use or after a long period of use of the apparatus. One of the deterrent factors relative to long and stable printing operations of liquid ejection apparatus is an increased viscosity of the liquid remaining at and near the liquid ejection orifices of the apparatus. Liquid having an increased viscosity can obstruct the proper ejection of liquid of the apparatus. The U.S. Pat. No. 9,090,084 discloses a liquid ejection head equipped with an auxiliary micro bubble generation pump formed by using a heating resistor element. A micro bubble generation pump is a circulation energy generation element for supplying fresh liquid that does not show any viscosity increase to a liquid circulation flow path in order to minimize the increase of liquid viscosity in the liquid ejection head.

A liquid ejection head disclosed in the U.S. Pat. No. 9,090,084 is required to drive the circulation energy generation element for a long period of time which can result in a decrease of the reliability of the liquid ejection head.

SUMMARY

A liquid ejection head according to the present disclosure includes an ejection orifice forming member having a liquid ejection orifice; and a substrate having a liquid flow path, wherein a liquid circulation flow path is disposed between the ejection orifice forming member and the substrate, the liquid circulation flow path includes a bubble generation chamber facing the liquid ejection orifice and is branched from the liquid flow path so as to pass through the bubble generation chamber and join the liquid flow path, the substrate has an ejection energy generation element which is arranged to face the bubble generation chamber and generates energy for ejecting liquid, in the bubble generation chamber, from the liquid ejection orifice and a circulation energy generation element which is arranged at a position, different from the position of the bubble generation chamber, to face the liquid circulation flow path and generates energy for circulating liquid in the liquid circulation flow path, the ejection energy generation element and the ejection orifice forming member are spaced from each other with a first gap and the circulation energy generation element and the ejection orifice forming member are spaced from each other with a second gap, the first gap and the second gap being different from each other.

Further features of the present disclosure will become apparent from the following description of exemplary embodiments with reference to the attached drawings.

DESCRIPTION OF THE EMBODIMENTS

Figure 1A:
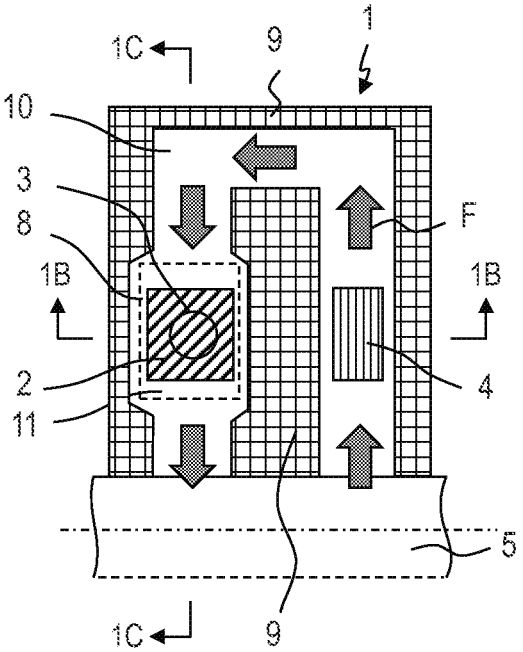
FIGS. 1A, 1B, 1C and 1D are schematic conceptual cross-sectional views of the first embodiment of liquid ejection head according to the present disclosure.

An aspect of the present disclosure provides a liquid ejection head comprising a circulation energy generation element for circulating liquid through a liquid circulation flow path that can maintain its high reliability after having been driven to operate for a long period of time.

Now, the present disclosure will be described in greater detail below by referring to the accompanying drawings that illustrate several embodiments of this disclosure. Note, however, that the relative positional arrangement and the profiles of the components of each of the embodiments shown in the drawings and described below are only exemplar ones and do not limit the scope of the present disclosure by any means. Also note that, while the embodiments described below are ink jet heads that eject ink, liquid to be ejected from a liquid ejection head according to the present disclosure is not limited to ink.

First Embodiment

Figure 1B:
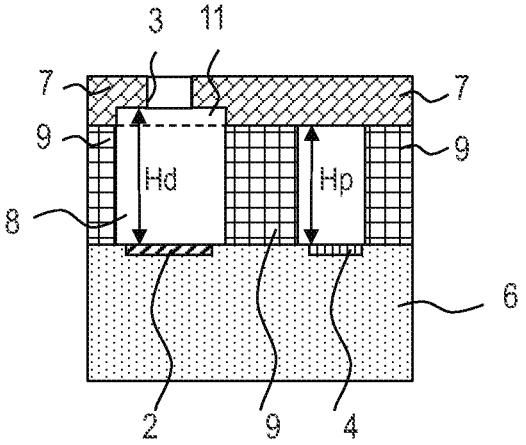
Figure 1C:
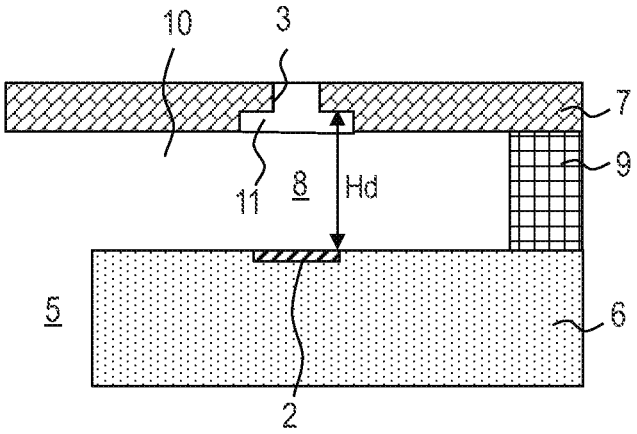

FIGS. 1A through 1D schematically illustrate the configuration of the first embodiment of liquid ejection head according to the present disclosure. More specifically, FIG. 1A is a schematic cross-sectional plan view of the liquid ejection head and FIG. 1B is a schematic cross-sectional view of the embodiment taken along line 1B-1B in FIG. 1A while FIG. 1C is a schematic cross-sectional view of the embodiment taken along line 1C-1C in FIG. 1A. The liquid ejection head 1 comprises a substrate 6 having a liquid flow path 5 through which liquid flows, a flat plate-shaped ejection orifice forming member 7 having a liquid ejection orifice 3 for ejecting liquid and flow path walls 9 arranged between the ejection orifice forming member 7 and the substrate 6. The substrate 6 is made of silicon (Si) and both the ejection orifice forming member 7 and the flow path walls 9 are made of photosensitive resin. The liquid flow path 5 is arranged in the substrate 6 and has openings. A liquid circulation flow path 10 is formed between the substrate 6 and the ejection orifice forming member 7. The liquid circulation flow path 10 is defined by the ejection orifice forming member 7, the flow path walls 9 and the substrate 6, The liquid circulation flow path 10 has a bubble generation chamber 8 that faces the liquid ejection orifice 3. The liquid circulation flow path 10 is branched from the liquid flow path 5 to form a substantially U-shaped liquid flow route that passes through the bubble generation chamber 8 and joins the liquid flow path 5.

An ejection energy generation element 2 is formed in the substrate 6. The ejection energy generation element 2 is arranged so as to face the bubble generation chamber 8 at a position located oppositely relative to the liquid ejection orifice 3. The ejection energy generation element 2 is formed by using a heater (heating resistor element) and generates energy for ejecting the liquid in the bubble generation chamber 8 from the liquid ejection orifice 3. The flow path width of the liquid circulation flow path 10 is made greater at the bubble generation chamber 8 than at any other site of the liquid circulation flow path 10 because the ejection energy generation element 2 needs to be arranged there. Then, as a result, the thickness of each of the flow path walls 9 relating to the bubble generation chamber 8 is reduced at the site located adjacent to the bubble generation chamber 8. In other words, the flow path walls 9 are notched at the sites thereof that face the bubble generation chamber 8. The liquid that flows from the liquid flow path 5 into the liquid circulation flow path 10 is heated by the ejection energy generation element 2 and the liquid that is heated and to which ejection energy is given and is then ejected from the liquid ejection orifice 3. The liquid, if any, that is not ejected from the liquid ejection orifice 3 keeps on flowing through the liquid circulation flow path 10 and returned to the liquid flow path 5. Thus, the liquid circulation flow path 10 provides a flow path through which liquid circulates.

A circulation energy generation element 4 is also formed in the substrate 6. The circulation energy generation element 4 is arranged at a position that is different from the position of the bubble generation chamber 8, which is located in this embodiment upstream relative to the ejection energy generation element 2 as viewed in the direction of liquid circulation so as to face the liquid circulation flow path 10. While not illustrated in the drawings, the circulation energy generation element 4 may alternatively be arranged downstream relative to the ejection energy generation element 2 so as to face the liquid circulation flow path 10. The circulation energy generation element 4 is formed by using a heater (heating resistor element) and generates energy necessary for circulating the liquid in the liquid circulation flow path 10 even when the ejection energy generation element 2 is not driven to operate. Since the amount of energy generated by the circulation energy generation element 4 per unit time is smaller than the comparable amount of energy generated by the ejection energy generation element 2, the planar size of the circulation energy generation element 4 is made smaller than that of the ejection energy generation element 2. For this reason, flow path width of the liquid circulation flow path 10 is not increased at the site where the circulation energy generation element 4 is arranged. The liquid in the liquid circulation flow path 10 is driven to circulate through the liquid circulation flow path 10 in the given direction indicated by allow F in FIG. 1A by the energy generated from the circulation energy generation element 4. Thus, with this arrangement, the increase in the viscosity, if any, of the liquid in the liquid circulation flow path 10 is minimized even when no liquid is ejected from the liquid ejection orifice 3 for a long period of time.

In the following description, the gap (distance) between the ejection energy generation element 2 and the ejection orifice forming member 7 in the direction orthogonal relative to the ejection orifice forming member 7 is expressed by Hd and the gap (distance) between the circulation energy generation element 4 and the ejection orifice forming member 7 in the direction orthogonal relative to the ejection orifice forming member 7 is expressed by Hp. While the ejection energy generation element 2 and the circulation energy generation element 4 may be covered by anti-cavitation film, such anti-cavitation film is very thin if compared with the gap Hd and the gap Hp and hence negligible. For this reason, such anti-cavitation film is not shown in FIGS. 1A through 1D. Hd may alternatively be defined as the gap (distance) between the wall surface of the liquid circulation flow path 10 located opposite to the ejection energy generation element 2 and the surface of the ejection energy generation element 2 and Hp may alternatively be defined as the gap (distance) between the wall surface of the liquid circulation flow path 10 located opposite to the circulation energy generation element 4 and the surface of the circulation energy generation element 4. Hd and Hp according to the above respective alternative definitions do not substantially differ from Hd and Hp according to the respective definitions that are given earlier.

Figure 12A:
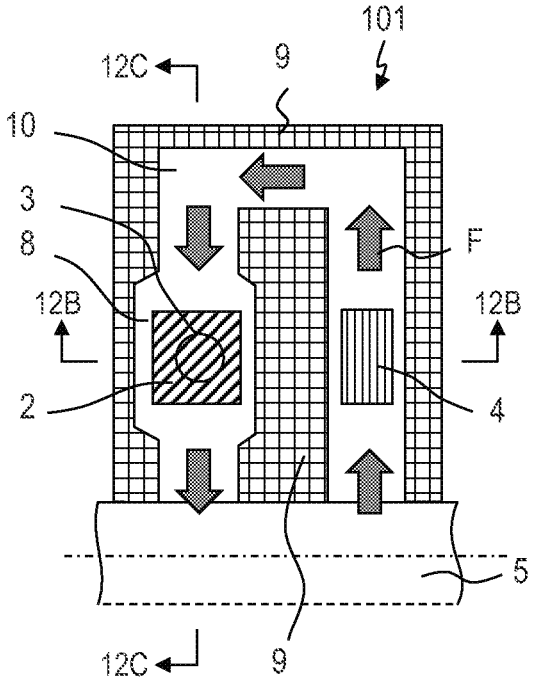
FIGS. 12A, 12B and 12C are schematic conceptual cross-sectional views of the liquid ejection head of a comparative example.
Figure 12B:
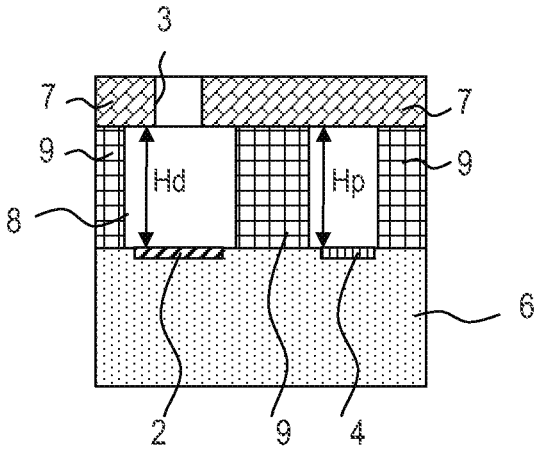
Figure 12C:
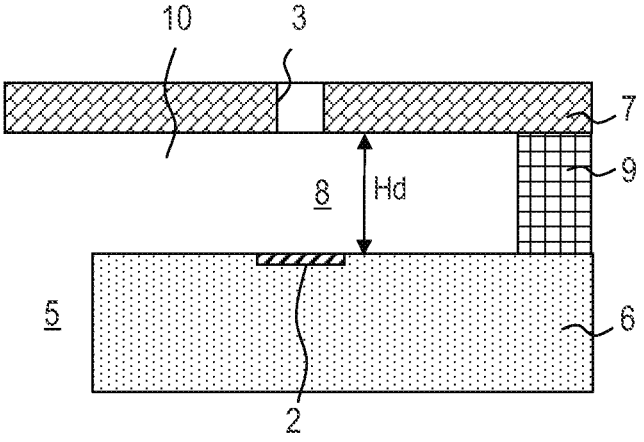

A liquid ejection head 101 of a comparative example will be described here. FIGS. 12A through 12C schematically illustrate the configuration of the liquid ejection head 101 of the comparative example and respectively correspond to FIGS. 1 through 1C. Hd and Hp are substantially equal to each other in the liquid ejection head 101 of the comparative example. In other words, the ejection energy generation element 2 and the circulation energy generation element 4 of this liquid ejection head 101 are formed on the same level in the substrate 6 and the surface of the ejection orifice forming member 7 that faces the liquid circulation flow path 10 is flat. Otherwise, the liquid ejection head 101 of the comparative example is the same as the liquid ejection head 1 of this embodiment.

On the other hand, Hd and Hp of this embodiment satisfy the relationship requirement of $Hd>1.1\times Hp$. The intended advantageous effects of the present disclosure can be achieved regardless of manufacturing variations when the difference between Hd and Hp is made greater than 10% of Hd as defined by the above inequality formula. For the purpose of satisfying the relationship requirement of $Hd>1.1\times Hp$, the ejection orifice forming member 7 is made to have a recess 11 at a position located oppositely relative to the ejection energy generation element 2 (the bubble generation chamber 8) and facing the liquid circulation flow path 10. Differently stated, a rectangular region of the ejection orifice forming member 7 that is concentric with the liquid ejection orifice 3 and the ejection energy generation element 2 is made thinner than the surrounding region as viewed in the direction orthogonal relative to the ejection orifice forming member 7. The recess 11 desirably entirely covers the ejection energy generation element 2 as viewed in the direction orthogonal relative to the ejection orifice forming member 7. Thus, this embodiment provides the following advantageous effects.

(1) The fact that the height of the cross section of the flow path in the bubble generation chamber 8 is adjustable as would be understandable by seeing the cross-sectional view of FIG. 1B allows the degree of freedom of the design of the liquid ejection head to be significantly raised. Particularly, since the height of the bubble generation chamber 8 of this embodiment is made greater than that of the bubble generation chamber 8 of the liquid ejection head of the comparable example, the cross-sectional area of the flow path in the bubble generation chamber 8 can be increased without reducing the thickness of each of the flow path walls 9 relating to the bubble generation chamber 8. Therefore, if the liquid ejection head of this embodiment is driven to operate for a long period of time, the risk that the flow path walls 9 come off from the substrate 6 is minimized. Additionally, as the thickness of each of the flow path walls 9 is increased, the risk that the flow path walls 9 come off from the substrate 6 is further reduced.

(2) The fact that the flow path length of the liquid ejection orifice 3 is reduced improves the ejection efficiency of the liquid ejection head and allows the amount of energy required to eject the liquid in the bubble generation chamber from the liquid ejection orifice 3 to be reduced. Then, the ejection energy generation element 2 can be downsized if compared with that of the liquid ejection head of the comparable example to in turn reduce the heating value of the ejection energy generation element 2. Then, the region that surrounds the ejection energy generation element 2 becomes less heated to in turn minimize the risk of degradation of the printed image quality due to accumulation of heat.

Now, the method of manufacturing the liquid ejection head 1 of this embodiment that was employed in an example will be described below. First, a Si substrate 6 having an ejection energy generation element 2 and a circulation energy generation element 4 formed therein in advance was brought in. Then, a film (with a film thickness of 15 μm) of a first negative type photosensitive material to be turned into the flow path walls 9 was formed on the surface of the substrate 6 by means of a spin coater and a laminator that are popularly available. Thereafter, the first negative type photosensitive material was exposed to light (to an exposure value of 10,000 J/m$^2$) by means of popularly available exposure equipment to produce a pattern for forming the flow path walls 9. Subsequently, a film (with a film thickness of 3 μm) of a second negative type photosensitive material to be turned into the lower layer of the ejection orifice forming member 7 was formed on the film of the first negative type photosensitive material by means of a spin coater and a laminator that are popularly available. Then, the second negative type photosensitive material was exposed to light (to an exposure value of 5,000 J/m$^2$) by means of popularly available exposure equipment to produce a pattern for forming the recess 11. Thereafter, a film (with a film thickness of 3 μm) of a third negative type photosensitive material to be turned into the upper layer of the ejection orifice forming member 7 was formed on the film of the second negative type photosensitive material by means of a spin coater and a laminator that are popularly available. Then, the third negative type photosensitive material was exposed to light (to an exposure value of 1,000 J/m$^2$) by means of popularly available exposure equipment to produce a pattern for forming the liquid ejection orifice 3. Thereafter, the first through third negative type photosensitive materials that had been exposed to light were collectively developed to obtain the liquid ejection head 1 having the recess 11 in the ejection orifice forming member 7. The same material may be employed for the first through third photosensitive materials or, alternatively, different materials may be employed for them. The operation of developing the first through third photosensitive materials may be executed for each of the photosensitive materials on a one by one basis.

Figure 1D:
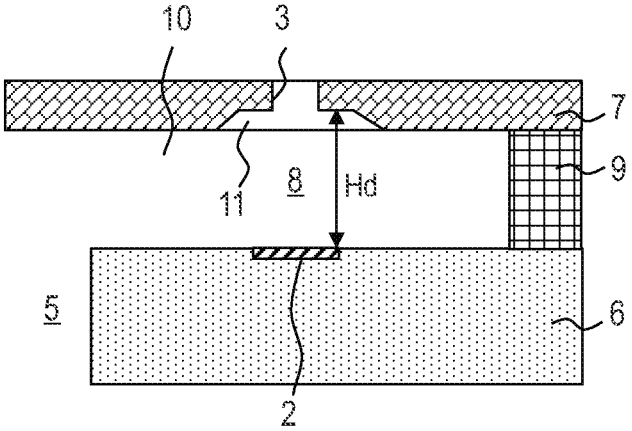

FIG. 1D is a view similar to FIG. 1C and illustrates a liquid ejection head obtained by modifying the first embodiment. One or both of the end regions of the recess 11 with respect to the direction along the liquid circulation flow path 10 is or are tapered. Liquid can be made to circulate more smoothly with this arrangement and hence the risk of generation of bubbles due to stagnation of liquid can be minimized.

Now, other currently preferable embodiments of the present disclosure will be described below. Hd and Hp satisfy the relationship requirement of $Hd>1.1\times Hp$ in each of the second through eighth embodiments (FIGS. 2A-2D through FIGS. 5A-5D), whereas Hd and Hp satisfy the relationship requirement of $1.1\times Hd<Hp$ in each of the ninth through sixteenth embodiments (FIGS. 6A-6D through FIGS. 11A-11D).

Second Embodiment

Figure 2A:
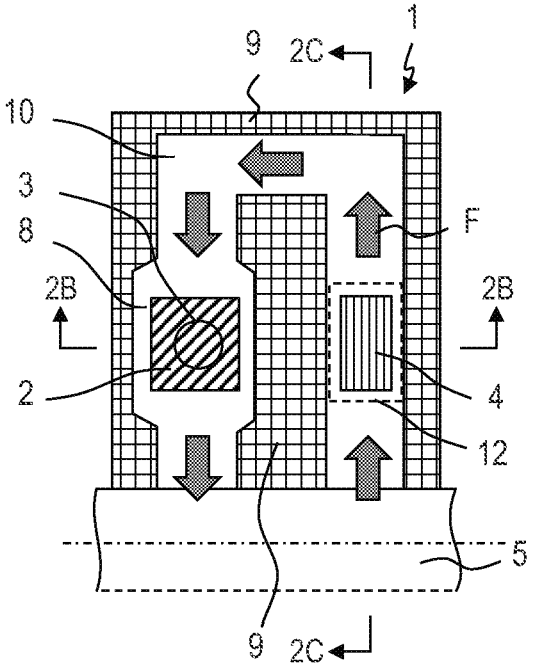
FIGS. 2A, 2B, 2C and 2D are schematic conceptual cross-sectional views of the second embodiment of liquid ejection head according to the present disclosure.
Figure 2B:
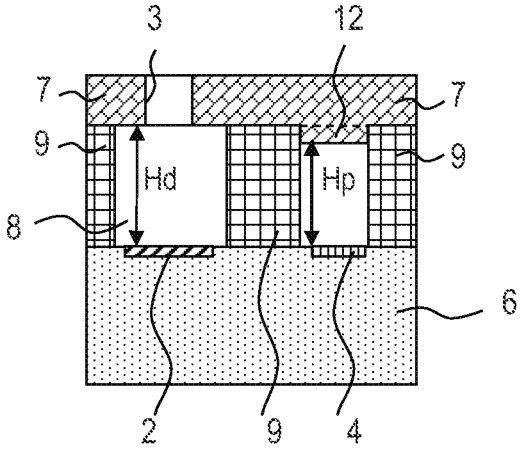
Figure 2C:
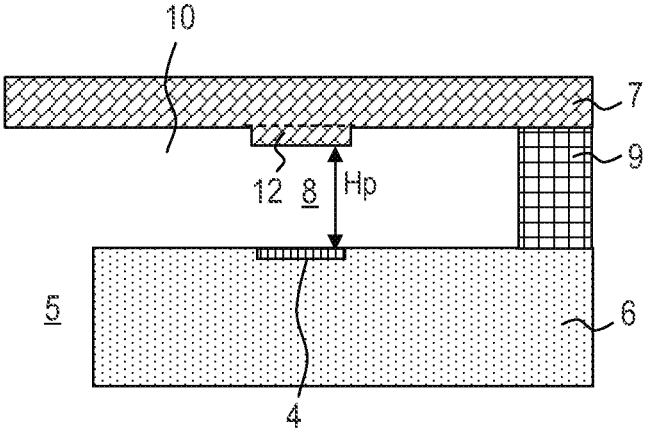

FIGS. 2A through 2C schematically illustrate the configuration of the second embodiment of liquid ejection head 1 according to the present disclosure and respectively correspond to FIGS. 1A through 1C. The ejection orifice forming member 7 of this embodiment has a protrusion 12 at a position located oppositely relative to the circulation energy generation element 4 and facing the liquid circulation flow path 10. Differently stated, a rectangular region of the ejection orifice forming member 7 that is concentric with the circulation energy generation element 4 as viewed in the direction orthogonal relative to the ejection orifice forming member 7 is made thicker than the surrounding region. The protrusion 12 desirably entirely covers the circulation energy generation element 4 as viewed in the direction orthogonal relative to the ejection orifice forming member 7. Thus, this embodiment provides the following advantageous effect.

(1) The fact that the cross-sectional area of the liquid circulation flow path 10 can be reduced without changing the width of the liquid circulation flow path 10 at and near the circulation energy generation element 4 allows liquid to circulate through the liquid circulation flow path 10 with small energy. Therefore, the circulation energy generation element 4 of this embodiment can be downsized if compared with that of the liquid ejection head of the comparative example to consequently reduce the impact that the generated bubbles give to the flow path wall 9. Then, the region that surrounds the ejection energy generation element 2 becomes less heated to in turn minimize the risk of degradation of the printed image quality due to accumulation of heat.

Figure 2D:
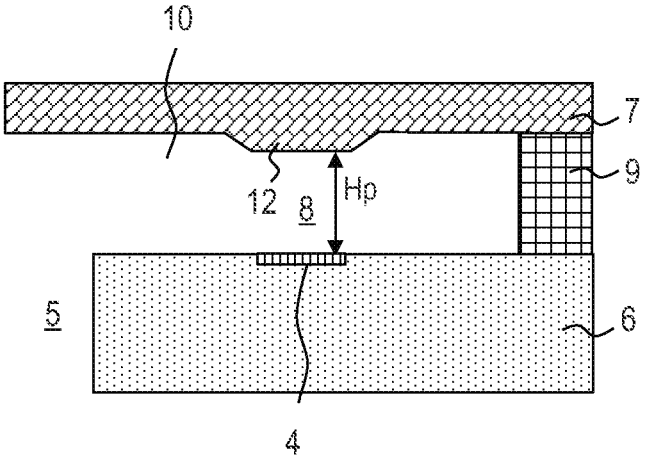

FIG. 2D is a view similar to FIG. 2C and illustrates a liquid ejection head obtained by modifying the second embodiment. One or both of the end regions of the protrusion 12 with respect to the direction along the liquid circulation flow path 10 is or are tapered. Liquid can be made to circulate more smoothly with this arrangement and hence the risk of generation of bubbles due to stagnation of liquid can be minimized.

Third Embodiment

Figure 3A:
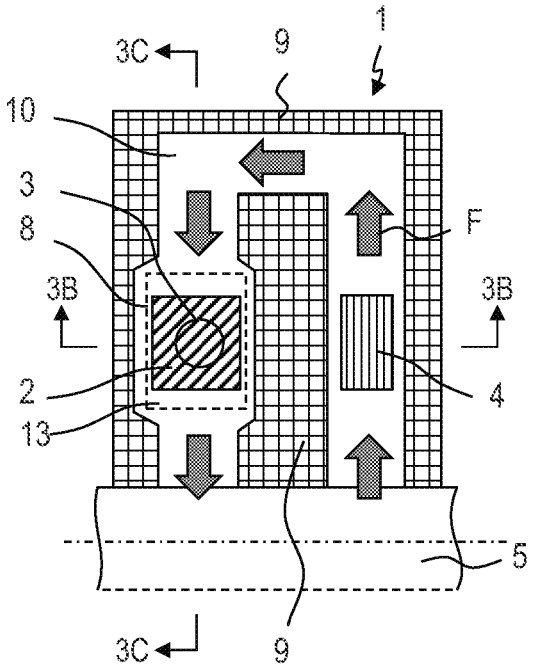
FIGS. 3A, 3B, 3C and 3D are schematic conceptual cross-sectional views of the third embodiment of liquid ejection head according to the present disclosure.
Figure 3B:
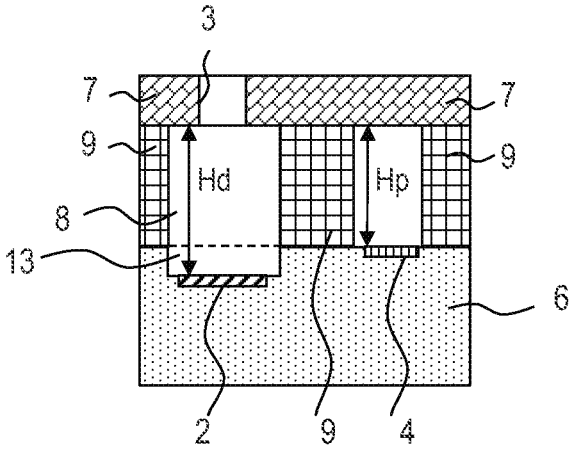
Figure 3C:
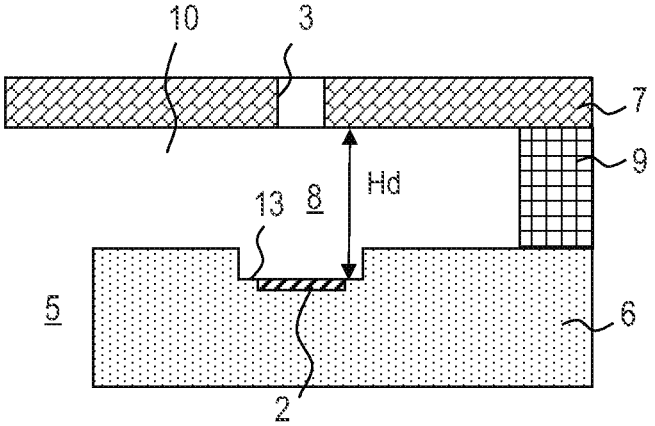

FIGS. 3A through 3C schematically illustrate the configuration of the third embodiment of liquid ejection head 1 according to the present disclosure and respectively correspond to FIGS. 1A through 1C. In this embodiment, the substrate 6 has a recess 13 that faces the liquid circulation flow path 10 (the bubble generation chamber 8) and the ejection energy generation element 2 is arranged in (under the bottom surface of) the recess 13. Differently stated, a rectangular region of the substrate 6 that is concentric with the liquid ejection orifice 3 and the ejection energy generation element 2 is made thinner than the surrounding region as viewed in the direction orthogonal relative to the ejection orifice forming member 7. The recess 13 desirably entirely contains the ejection energy generation element 2 in it as viewed in the direction orthogonal relative to the ejection orifice forming member 7. The recess 13 can, for instance, be produced by dry etching the substrate 6. Thus, this embodiment provides the following advantageous effects.

(1) An advantageous effect similar to that of (1) described above for the first embodiment.

(2) The direct distance between the ejection energy generation element 2 and the circulation energy generation element 4 of this embodiment can be made greater than the corresponding distance of the liquid ejection head of the comparable example. For this reason, accumulation of heat hardly takes place at and near the ejection energy generation element 2 of the substrate 6 even when the circulation energy generation element 4 is driven to operate continuously for a long period of time. Then, as a result, a clear thermal contrast is observable between when the ejection energy generation element 2 is on and when the ejection generation element 2 is off and also between when the circulation energy generation element 4 is on and when the circulation energy generation element 4 is off to make it possible to improve the printed image quality of the liquid ejection head of this embodiment.

Figure 3D:
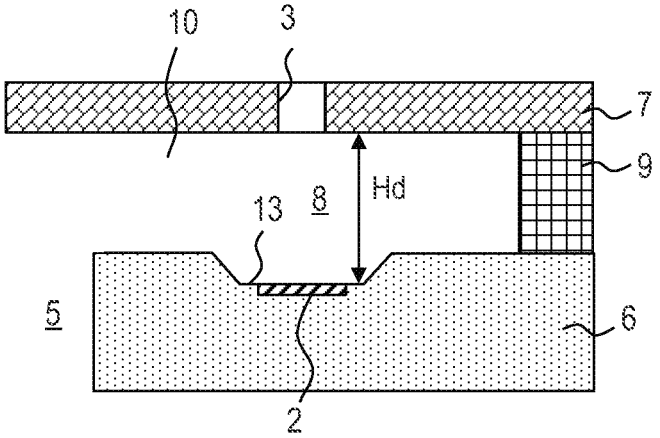

FIG. 3D is a view similar to FIG. 3C and illustrates a liquid ejection head obtained by modifying the third embodiment. One or both of the end regions of the recess 13 with respect to the direction along the liquid circulation flow path 10 is or are tapered. Therefore, this modified third embodiment provides advantageous effects similar to those of the above-described modified first embodiment.

Fourth Embodiment

Figure 4A:
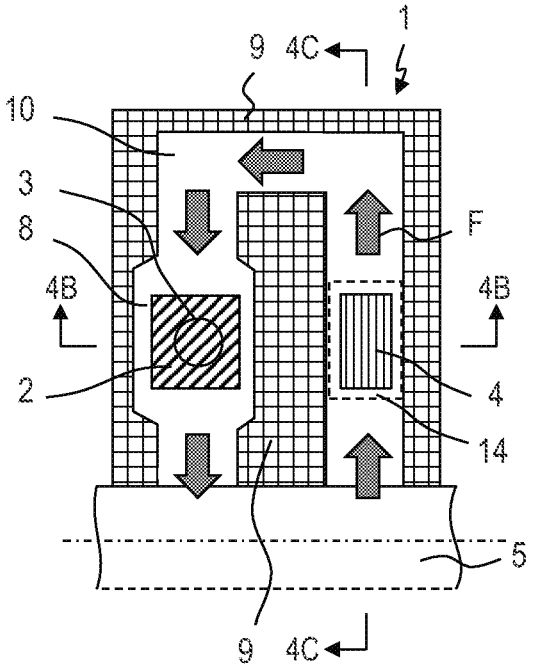
FIGS. 4A, 4B, 4C and 4D are schematic conceptual cross-sectional views of the fourth embodiment of liquid ejection head according to the present disclosure.
Figure 4B:
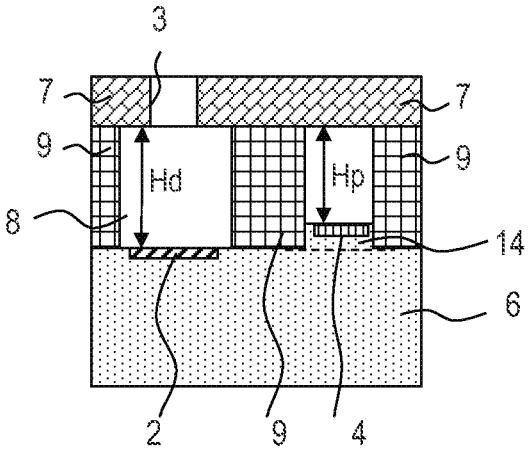
Figure 4C:
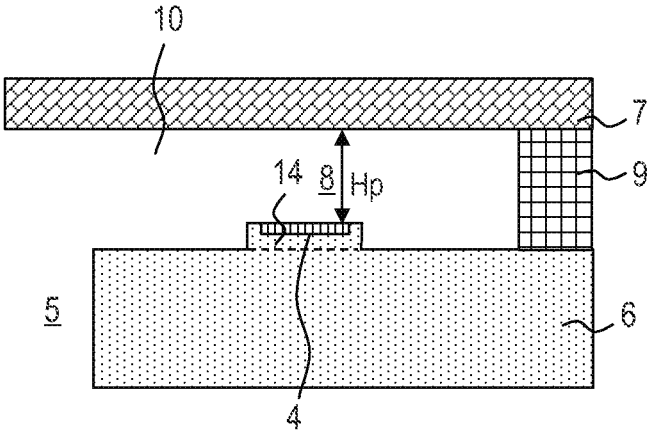

FIGS. 4A through 4C schematically illustrate the configuration of the fourth embodiment of liquid ejection head 1 according to the present disclosure and respectively correspond to FIGS. 1A through 1C. The substrate 6 of this embodiment has a protrusion 14 at a position facing the liquid circulation flow path 10 and the circulation energy generation element 4 is arranged in (under the top surface of) the protrusion 14. Differently stated, a rectangular region of the substrate 6 that is concentric with the circulation energy generation element 4 as viewed in the direction orthogonal relative to the ejection orifice forming member 7 is made thicker than the surrounding region. The protrusion 14 desirably entirely includes the circulation energy generation element 4 as viewed in the direction orthogonal relative to the ejection orifice forming member 7. For instance, the protrusion 14 is formed by subjecting the substrate 6 to sputtering. Thus, this embodiment provides the following advantageous effects.

(1) An advantageous effect similar to that of (1) described above for the second embodiment.

(2) An advantageous effect similar to that of (2) described above for the third embodiment.

Figure 4D:
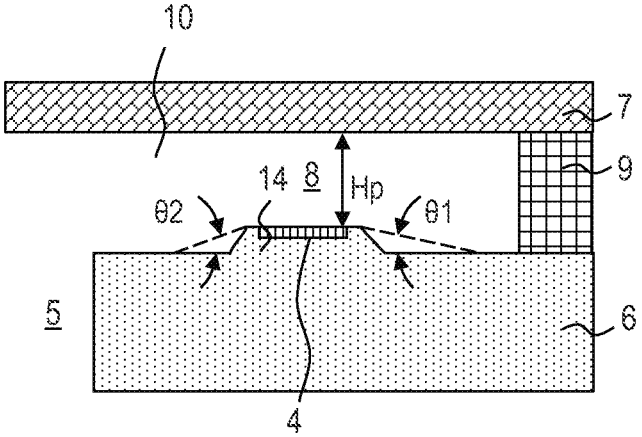

FIG. 4D is a view similar to FIG. 4C and illustrates a liquid ejection head obtained by modifying the fourth embodiment. One or both of the end regions of the protrusion 14 with respect to the direction along the liquid circulation flow path 10 is or are tapered. Therefore, this modified fourth embodiment provides advantageous effects similar to those of the above-described modified second embodiment. Additionally, liquid can be made to circulate more smoothly when one or both of the end regions is or are tapered only mildly as shown by a broken line or broken lines, as shown in FIG. 4D. Liquid can be made to circulate further smoothly when the taper angle θ1 on the side the bubble generation chamber 8 is made smaller than the taper angle θ2 on the side of the liquid flow path 5.

Fifth Embodiment

Figure 5A:
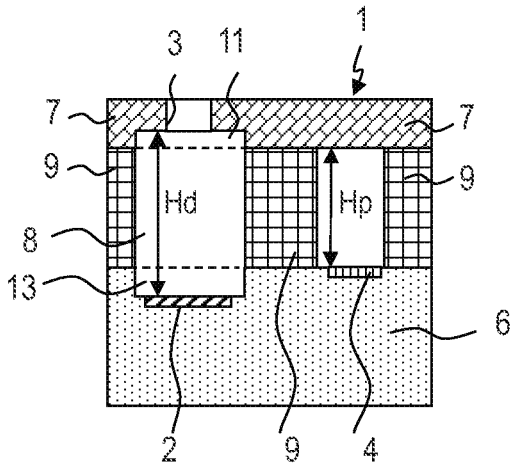
FIGS. 5A, 5B, 5C and 5D are respective schematic conceptual cross-sectional views of the fifth through eighth embodiments of liquid ejection head according to the present disclosure.

FIG. 5A schematically illustrates the configuration of the fifth embodiment of liquid ejection head 1 according to the present disclosure and corresponds to FIG. 1B. The ejection orifice forming member 7 of this embodiment has a first recess 11 at a position located oppositely relative to the ejection energy generation element 2 (the bubble generation chamber 8) and facing the liquid circulation flow path 10. The substrate 6 has a second recess 13 at a position facing the liquid circulation flow path 10 (the bubble generation chamber 8) and the ejection energy generation element 2 is arranged in the second recess 13. This embodiment has the characteristic feature of the first embodiment and that of the third embodiment in combination and hence this embodiment provides the advantageous effects of the first and third embodiments.

Sixth Embodiment

Figure 5B:
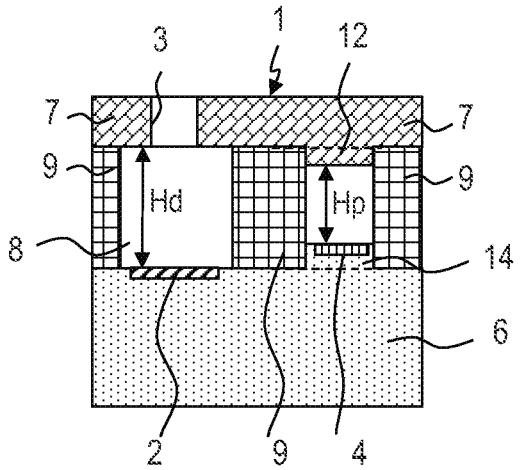

FIG. 5B schematically illustrates the configuration of the sixth embodiment of liquid ejection head 1 according to the present disclosure and corresponds to FIG. 1B. The ejection orifice forming member 7 of this embodiment has a first protrusion 12 at a position located oppositely relative to the circulation energy generation element 4 and facing the liquid circulation flow path 10. The substrate 6 has a second protrusion 14 at a position facing the liquid circulation flow path 10 and the circulation energy generation element 4 is arranged in the second protrusion 14. This embodiment has the characteristic feature of the second embodiment and that of the fourth embodiment in combination and hence this embodiment provides the advantageous effects of the second and fourth embodiments.

Seventh Embodiment

Figure 5C:
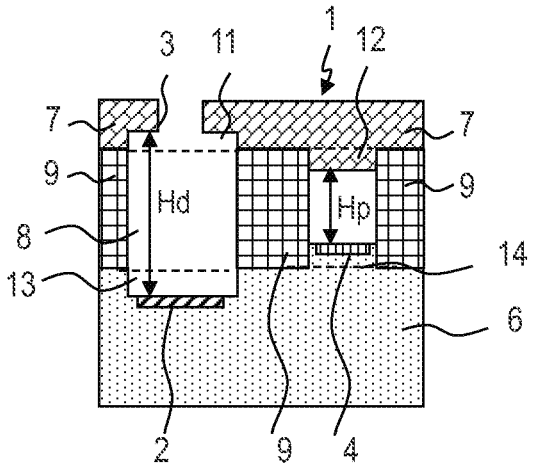

FIG. 5C schematically illustrates the configuration of the seventh embodiment of liquid ejection head 1 according to the present disclosure and corresponds to FIG. 1B. The ejection orifice forming member 7 of this embodiment has a first recess 11 at a position located oppositely relative to the ejection energy generation element 2 and facing the liquid circulation flow path 10. The substrate 6 has a second recess 13 at a position facing the liquid circulation flow path 10 (the bubble generation chamber 8) and the ejection energy generation element 2 is arranged in the second recess 13. Additionally, the ejection orifice forming member 7 of this embodiment has a first protrusion 12 at a position located oppositely relative to the circulation energy generation element 4 and facing the liquid circulation flow path 10. The substrate 6 has a second protrusion 14 at a position facing the liquid circulation flow path 10 and the circulation energy generation element 4 is arranged in the second protrusion 14. The value of Hd is maximized relative to that of Hp in this embodiment. This embodiment has the characteristic features of the first through fourth embodiments in combination and hence this embodiment provides the advantageous effects of the first through fourth embodiments.

Eighth Embodiment

Figure 5D:
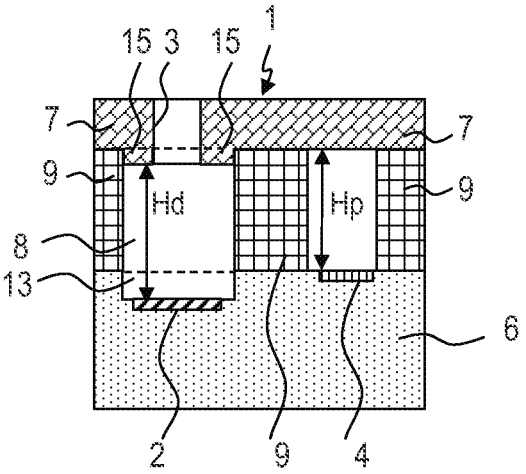

FIG. 5D schematically illustrates the configuration of the eighth embodiment of liquid ejection head according to the present disclosure and corresponds to FIG. 1B. The ejection orifice forming member 7 of this embodiment has a protrusion 15 at a position located oppositely relative to the ejection energy generation element 2 and facing the liquid circulation flow path 10. The substrate 6 has a recess 13 at a position facing the liquid circulation flow path 10 (the bubble generation chamber 8) and the ejection energy generation element 2 is arranged in the recess 13. The depth of the recess 13 is greater than the height (projecting length) of the protrusion 15. As a whole, the bubble generation chamber 8 of this embodiment is positionally shifted toward the side of the substrate 6 when compared with the bubble generation chamber 8 of the liquid ejection head of the comparative example. For this reason, this embodiment provides an advantageous effect similar to that of (1) described above for the first embodiment and an advantageous effect similar to that of (2) described above for the third embodiment without remarkably modifying the cross-sectional area of the flow path in the bubble generation chamber 8 of the liquid ejection head 1 of the comparable example for the cross-sectional area of the flow path in the bubble generation chamber 8 of this embodiment.

Ninth Embodiment

Figure 6A:
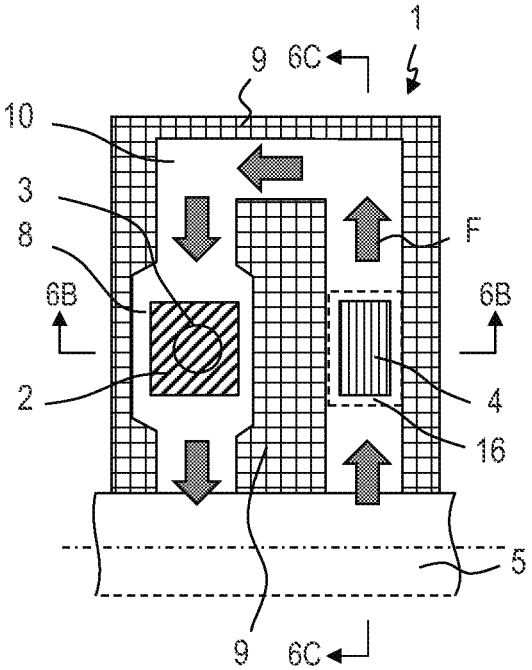
FIGS. 6A, 6B, 6C and 6D are schematic conceptual cross-sectional views of the ninth embodiment of liquid ejection head according to the present disclosure.
Figure 6B:
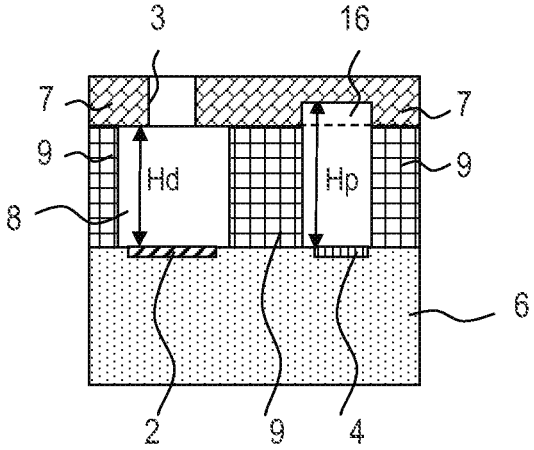
Figure 6C:
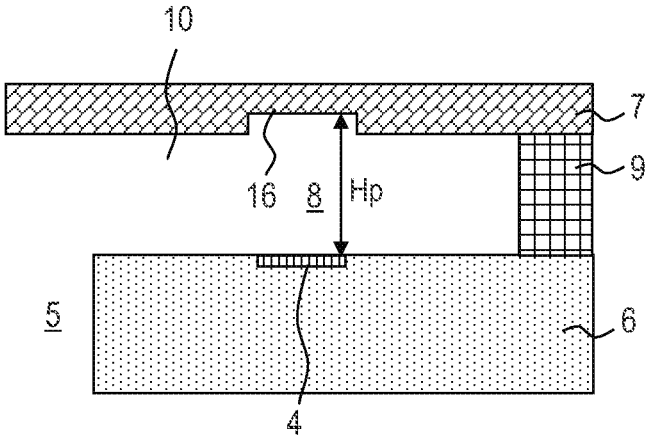

FIGS. 6A through 6C schematically illustrate the configuration of the ninth embodiment of liquid ejection head 1 according to the present disclosure and respectively correspond to FIGS. 1A through 1C. The ejection orifice forming member 7 of this embodiment has a recess 16 at a position located oppositely relative to the circulation energy generation element 4 and facing the liquid circulation flow path 10. Differently stated, a rectangular region of the ejection orifice forming member 7 that is concentric with the circulation energy generation element 4 as viewed in the direction orthogonal relative to the ejection orifice forming member 7 is made thinner than the surrounding region. The recess 16 desirably entirely covers the circulation energy generation element 4 as viewed in the direction orthogonal relative to the ejection orifice forming member 7. Thus, this embodiment provides the following advantageous effects.

(1) When compared with the preceding embodiments, the circulation energy generation element 4 and the ejection orifice forming member 7 are separated from each other by a relatively large distance to consequently reduce the impact that the generated bubbles give to the ejection orifice forming member 7. Thus, the damage, if any, that is given to the ejection orifice forming member 7 is minimized to in turn improve the durability of the ejection orifice forming member 7.

Figure 6D:
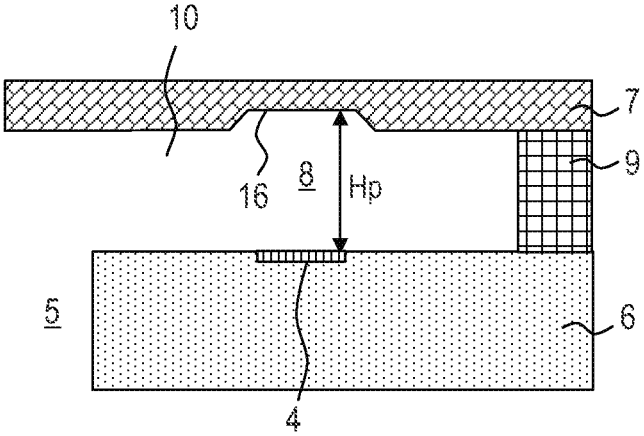

FIG. 6D is a view similar to FIG. 6C and illustrates a liquid ejection head obtained by modifying the ninth embodiment. One or both of the end regions of the recess 16 with respect to the direction along the liquid circulation flow path 10 is or are tapered. This modified ninth embodiment provides effects similar to those of the above-described modified first embodiment.

Tenth Embodiment

Figure 7A:
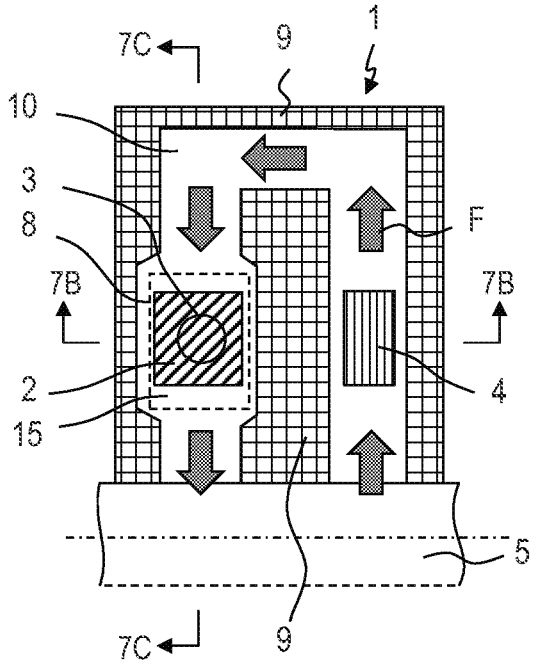
FIGS. 7A, 7B, 7C and 7D are schematic conceptual cross-sectional views of the tenth embodiment of liquid ejection head according to the present disclosure.
Figure 7B:
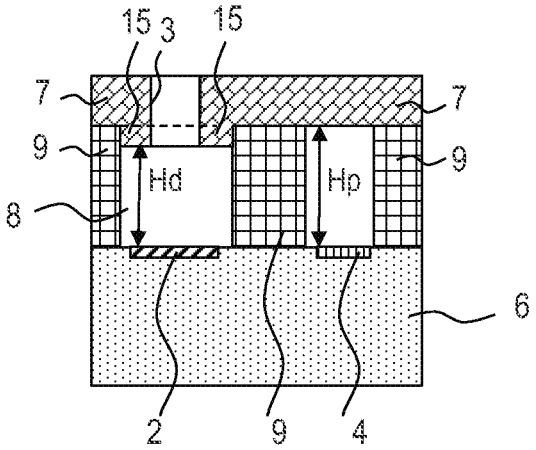
Figure 7C:
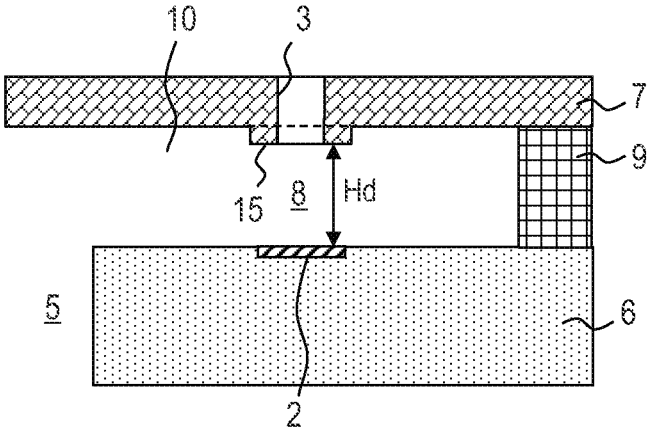

FIGS. 7A through 7C schematically illustrate the configuration of the tenth embodiment of liquid ejection head 1 according to the present disclosure and respectively correspond to FIGS. 1A through 1C. The ejection orifice forming member 7 of this embodiment has a protrusion 15 at a position located oppositely relative to the ejection energy generation element 2 and facing the liquid circulation flow path 10. Differently stated, a rectangular region of the ejection orifice forming member 7 that is concentric with the liquid ejection orifice 3 and the ejection energy generation element 2 as viewed in the direction orthogonal relative to the ejection orifice forming member 7 is made thicker than the surrounding region. The protrusion 15 desirably entirely covers the circulation energy generation element 4 as viewed in the direction orthogonal relative to the ejection orifice forming member 7. Thus, this embodiment provides the following advantageous effect.

(1) The fact that the height of the flow path in the bubble generation chamber 8 is adjustable allows the degree of freedom of the design of the liquid ejection head 1 to be significantly raised. Particularly, since the height of the bubble generation chamber 8 is made smaller than that of the bubble generation chamber 8 of the liquid ejection head of the comparable example, the cross-sectional area of the flow path in the bubble generation chamber 8 can be reduced and how much the cross-sectional can be reduced is not restricted by the width of the ejection energy generation element 2. Since the difference between the cross-sectional area of the bubble generation chamber 8 in the liquid circulation flow path 10 and the cross-sectional area of any part of the liquid calculation flow path 10 other than the bubble generation chamber 8 can be reduced, stagnation of liquid circulating through the liquid circulation flow path 10 can be minimized.

Figure 7D:
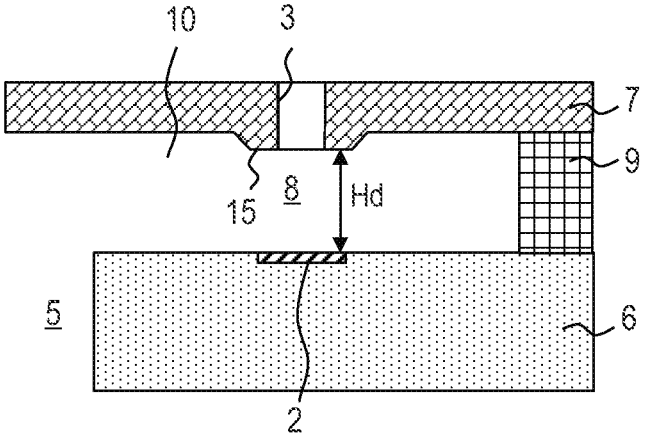

FIG. 7D is a view similar to FIG. 7C and illustrates a liquid ejection head obtained by modifying the tenth embodiment. One or both of the end regions of the protrusion 15 with respect to the direction along the liquid circulation flow path 10 is or are tapered. This modified ninth embodiment provides advantageous effects similar to those of the above-described modified first embodiment.

11th Embodiment

Figure 8A:
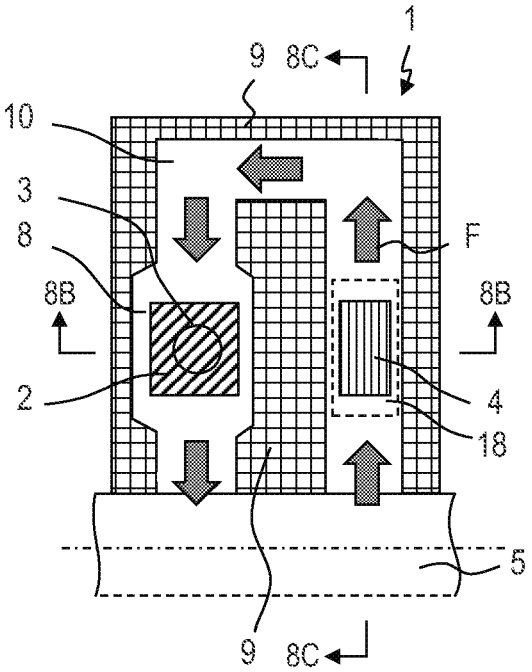
FIGS. 8A, 8B, 8C and 8D are schematic conceptual cross-sectional views of the eleventh embodiment of liquid ejection head according to the present disclosure.
Figure 8B:
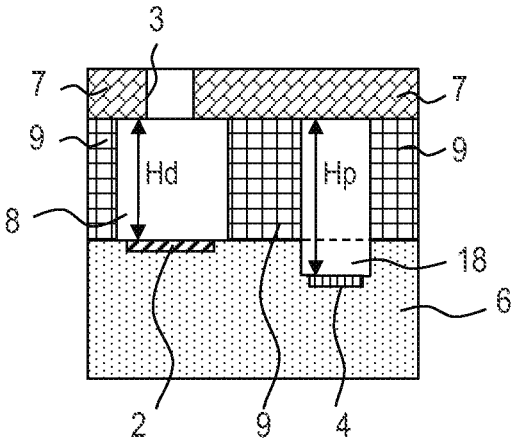
Figure 8C:
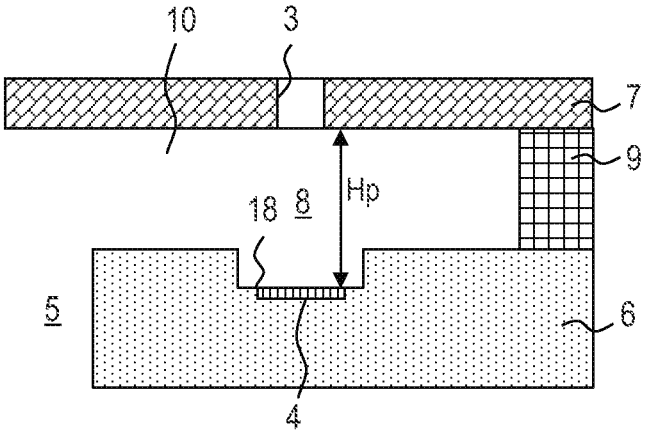

FIGS. 8A through 8C schematically illustrate the configuration of the eleventh embodiment of liquid ejection head 1 according to the present disclosure and respectively correspond to FIGS. 1A through 1C. The substrate 6 of this embodiment has a recess 18 at a position facing the liquid circulation flow path 10 and the circulation energy generation element 4 is arranged in the recess 18. Differently stated, a rectangular region of the substrate 6 that is concentric with the circulation energy generation element 4 as viewed in the direction orthogonal relative to the ejection orifice forming member 7 is made thinner than the surrounding region. The recess 18 desirably entirely includes the circulation energy generation element 4 as viewed in the direction orthogonal relative to the ejection orifice forming member 7. Thus, this embodiment provides the following advantageous effects.

(1) An effect similar to that of (1) described above for the ninth embodiment.

(2) An effect similar to that of (2) described above for the third embodiment.

Figure 8D:
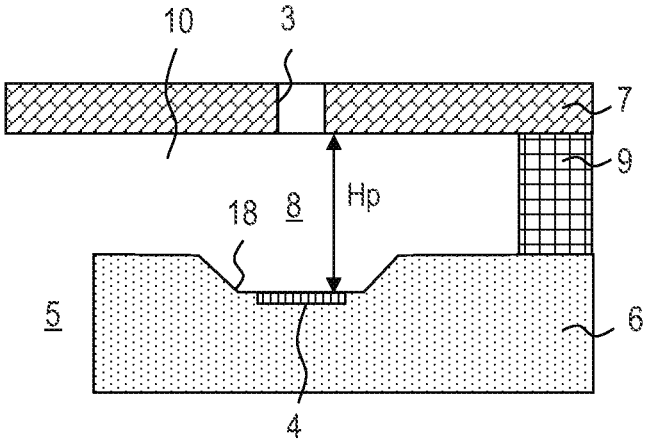

FIG. 8D is a view similar to FIG. 8C and illustrates a liquid ejection head obtained by modifying the eleventh embodiment. One or both of the end regions of the recess 18 with respect to the direction along the liquid circulation flow path 10 is or are tapered. This modified eleventh embodiment provides advantageous effects similar to those of the above-described modified second embodiment.

(12th Embodiment

Figure 9A:
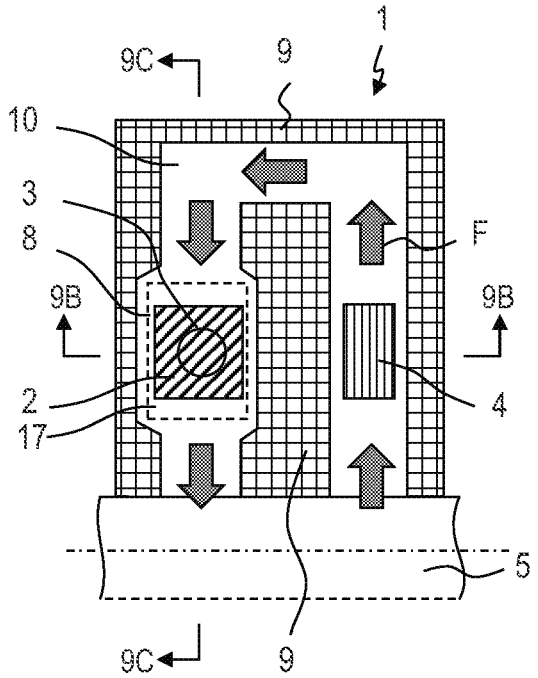
FIGS. 9A, 9B, 9C and 9D are schematic conceptual cross-sectional views of the twelfth embodiment of liquid ejection head according to the present disclosure.
Figure 9B:
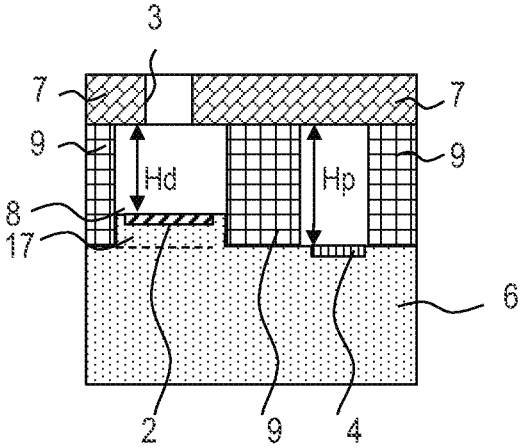
Figure 9C:
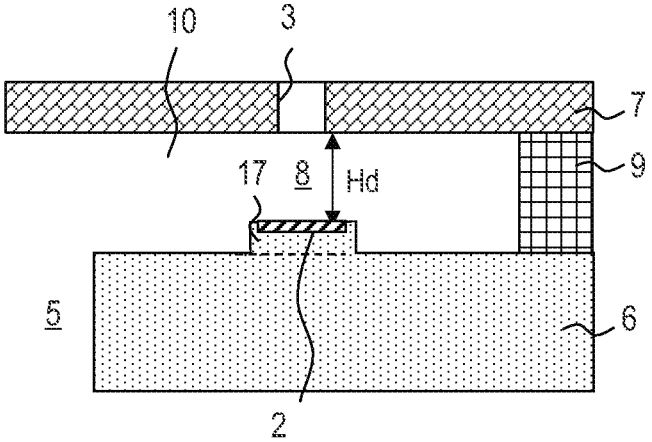

FIGS. 9A through 9C schematically illustrate the configuration of the twelfth embodiment of liquid ejection head 1 according to the present disclosure and respectively correspond to FIGS. 1A through 1C. The substrate 6 of this embodiment has a protrusion 17 at a position facing the liquid circulation flow path 10 (the bubble generation chamber 8) and the ejection energy generation element 2 is arranged in the protrusion 17. Differently stated, a rectangular region of the substrate 6 that is concentric with the liquid ejection orifice 3 and the ejection enemy generation element 2 as viewed in the direction orthogonal relative to the ejection orifice forming member 7 is made thicker than the surrounding region. The protrusion 17 desirably entirely includes the circulation energy generation element 4 as viewed in the direction orthogonal relative to the ejection orifice forming member 7. Thus, this embodiment provides the following advantageous effects.

(1) An advantageous effect similar to that of (1) described above for the tenth embodiment.

(2) An advantageous effect similar to that of (2) described above for the third embodiment.

Figure 9D:
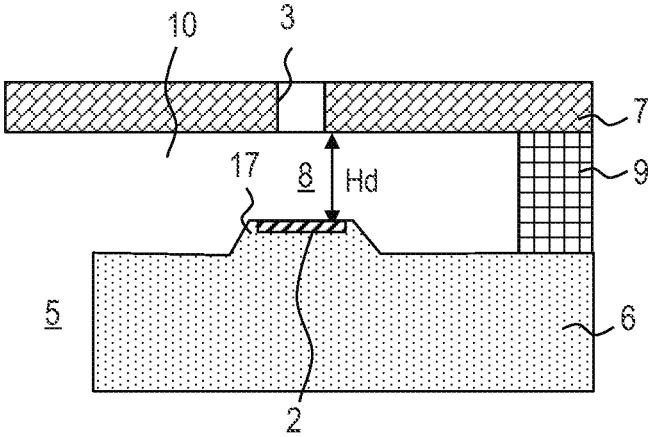

FIG. 9D is a view similar to FIG. 9C and illustrates a liquid ejection head obtained by modifying the twelfth embodiment. One or both of the end regions of the protrusion 17 with respect to the direction along the liquid circulation flow path 10 is or are tapered. This modified eleventh embodiment provides advantageous effects similar to those of the above-described modified second embodiment.

13th Embodiment

Figure 10A:
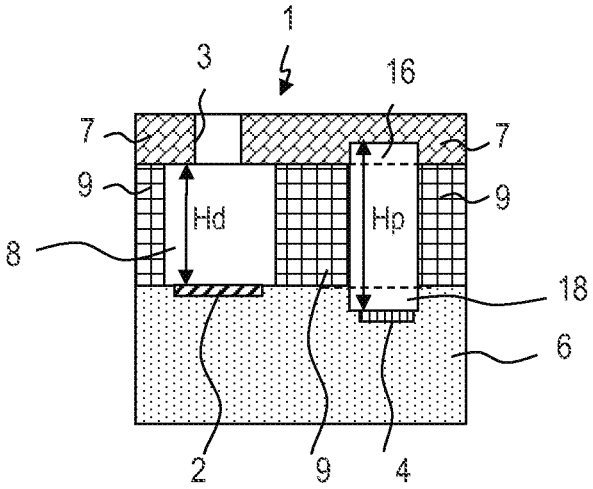
FIGS. 10A, 10B and 10C are respective schematic conceptual cross-sectional views of the thirteenth through fifteenth embodiments of liquid ejection head according to the present disclosure.

FIG. 10A schematically illustrates the configuration of the thirteenth embodiment of liquid ejection head 1 according to the present disclosure and corresponds to FIG. 1B. The ejection orifice forming member 7 of this embodiment has a first recess 16 at a position located oppositely relative to the circulation energy generation element 4 and facing the liquid circulation flow path 10. The substrate 6 has a second recess 18 at a position facing the liquid circulation flow path 10 and the circulation energy generation element 4 is arranged in the second recess 13. This embodiment has the characteristic feature of the ninth embodiment and that of the eleventh embodiment in combination and hence this embodiment provides the advantageous effects of the ninth and eleventh embodiments.

14th Embodiment

Figure 10B:
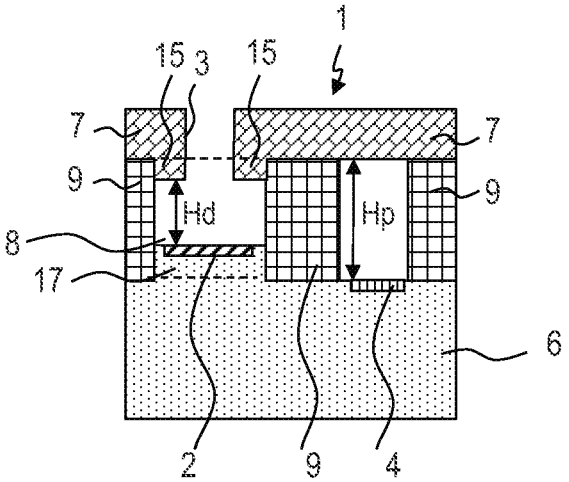

FIG. 10B schematically illustrates the configuration of the fourteenth embodiment of liquid ejection head 1 according to the present disclosure and corresponds to FIG. 1B. The ejection orifice forming member 7 of this embodiment has a first protrusion 15 at a position located oppositely relative to the ejection energy generation element 2 (the bubble generation chamber 8) and facing the liquid circulation flow path 10 (the bubble generation chamber 8). The substrate 6 has a second protrusion 17 at a position facing the liquid circulation flow path 10 and the ejection energy generation element 2 is arranged in the second protrusion 17. This embodiment has the characteristic feature of the eighth embodiment and that of the tenth embodiment in combination and hence this embodiment provides the advantageous effects of the eighth and tenth embodiments.

15th Embodiment

Figure 10C:
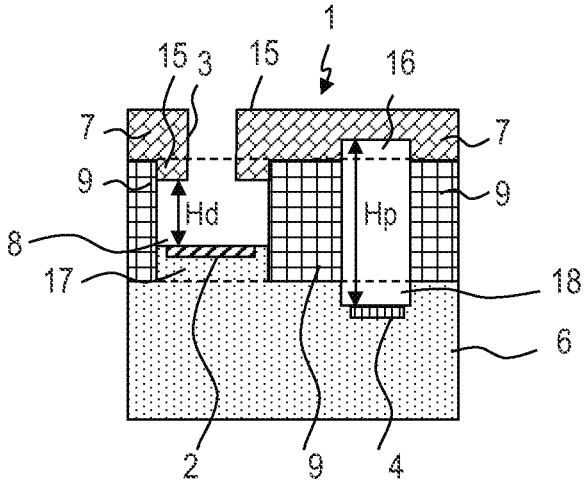

FIG. 10C schematically illustrates the configuration of the fifteenth embodiment of liquid ejection head 1 according to the present disclosure and corresponds to FIG. 1B. The ejection orifice forming member 7 of this embodiment has a first recess 16 at a position located oppositely relative to the circulation energy generation element 4 and facing the liquid circulation flow path 10. The substrate 6 has a second recess 18 at a position facing the liquid circulation flow path 10 and the circulation energy generation element 4 is arranged in the second recess 18. The ejection orifice forming member 7 of this embodiment has a first protrusion 15 at a position located oppositely relative to the ejection energy generation element 2 and facing the liquid circulation flow path 10. The substrate 6 has a second protrusion 17 at a position facing the liquid circulation flow path 10 (the bubble generation chamber 8) and the ejection energy generation element 2 is arranged in the second protrusion 17. The value of Hd is minimized relative to that of Hp in this embodiment. This embodiment has the characteristic features of the eighth through eleventh embodiments in combination and hence this embodiment provides the advantageous effects of the eighth through eleventh embodiments.

16th Embodiment

Figure 11A:
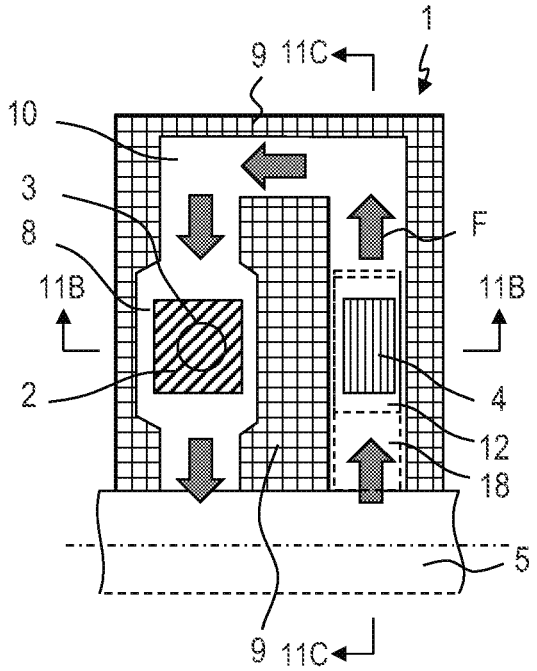
FIGS. 11A, 11B, 11C and 11D are schematic conceptual cross-sectional views of the sixteenth embodiment of liquid ejection head according to the present disclosure.
Figure 11B:
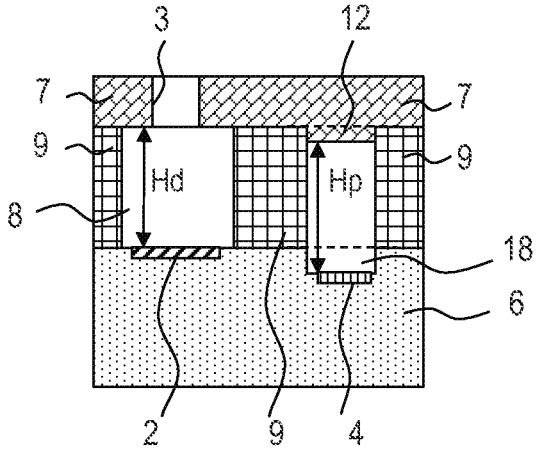
Figure 11C:
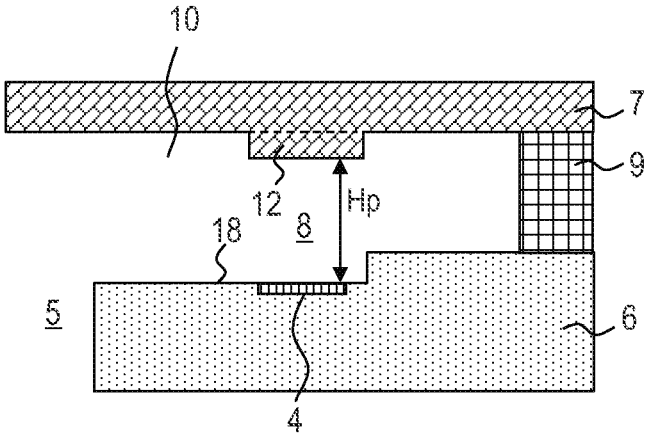

FIGS. 11A through 11C schematically illustrate the configuration of the sixteenth embodiment of liquid ejection head 1 according to the present disclosure and respectively correspond to FIGS. 1A through 1C. The ejection orifice forming member 7 of this embodiment has a protrusion 12 at a position located oppositely relative to the circulation energy generation element 4 and facing the liquid circulation flow path 10. The substrate 6 has a recess 18 located at a position facing the liquid circulation flow path 10 and the circulation energy generation element 4 is arranged in the recess 18. The recess 18 has a depth greater than the height of the protrusion 12. When compared with the liquid ejection head of the comparative example, the site located under the liquid circulation flow path 10 where the circulation energy generation element 4 is arranged is shifted toward the side of the substrate 6 as a whole. For this reason, an advantageous effect similar to that of (1) described above for the 9th embodiment and an advantageous effect similar to that of (2) described above for the third embodiment can be obtained without significantly changing the cross-sectional area of the liquid circulation flow path 10 at the site where the circulation energy generation element 4 is arranged from the corresponding cross-sectional area of the liquid circulation flow path 10 of the liquid ejection head of the comparative example.

Figure 11D:
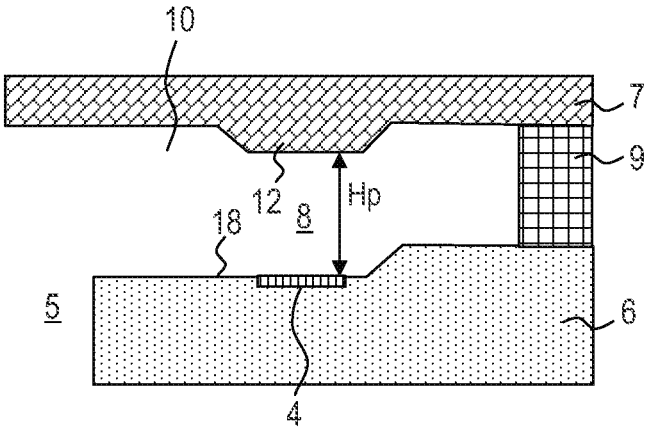

FIG. 11D is a view similar to FIG. 11C and illustrates a liquid ejection head 1 obtained by modifying the sixteenth embodiment. One or both of the end regions of the protrusion 12 with respect to the direction along the liquid circulation flow path 10 is or are tapered. This modified sixteenth embodiment provides advantageous effects similar to those of the above-described modified second embodiment. Additionally, since one or both of the end regions of the recess 18 with respect to the direction along the liquid circulation flow path 10 is or are tapered, this modified sixteenth embodiment provides advantageous effects similar to those of the above-described modified second embodiment. Since the recess 18 is formed continuously to get to the liquid flow path 5, an increased volume of liquid can be taken into the liquid circulation flow path 10.

The present disclosure is described above by way of a number of embodiments. However, the scope of the present disclosure is by no means limited by the above-described embodiments. Each of the part of the substrate 6 where the ejection energy generation element 2 is arranged, the part of the ejection orifice forming member 7 located oppositely relative to the ejection energy generation element 2, the part of the substrate 6 where the circulation energy generation element 4 is arranged and the part of the ejection orifice forming member 7 located oppositely relative to the circulation energy generation element 4 can independently take one of three alternative profiles including a brought-up profile as compared with the profile of the corresponding part of the liquid ejection head of the comparative example, a profile same as the profile of the corresponding part of the liquid ejection head of the comparative example and a brought-down profile as compared with the profile of the corresponding part of the liquid ejection head of the comparative example. Any one or two or all of the three possible profiles on the part of the substrate 6 can arbitrarily be combined with any one or two or all of the three possible profiles on the part of the ejection orifice forming member 7. All the possible combinations are within the scope of the present disclosure so long as the relationship requirement of $Hd>1.1\times Hp$ or $1.1\times Hd<Hp$ is satisfied.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-181239, filed Oct. 1, 2019, which is hereby incorporated by reference herein in its entirety.

What is claimed is:

1. A liquid ejection head comprising:

an ejection orifice forming member having a liquid ejection orifice; and a substrate having a liquid flow path, wherein a liquid circulation flow path is disposed between the ejection orifice forming member and the substrate, the liquid circulation flow path includes a bubble generation chamber facing the liquid ejection orifice and is branched from the liquid flow path so as to pass through the bubble generation chamber and join the liquid flow path, the substrate has an ejection energy generation element which is arranged to face the bubble generation chamber and generates energy for ejecting liquid, in the bubble generation chamber, from the liquid ejection orifice and a circulation energy generation element which is arranged at a position, different from the position of the bubble generation chamber, to face the liquid circulation flow path and generates energy for circulating liquid in the liquid circulation flow path, the ejection energy generation element and the ejection orifice forming member are spaced from each other with a first gap and the circulation energy generation element and the ejection orifice forming member are spaced from each other with a second gap, the first gap and the second gap being different from each other, wherein the ejection orifice forming member has a protrusion protruding into the liquid circulation flow path at a position located opposite to at least one of the circulation energy generation element and the ejection energy generation element.

2. A liquid ejection head comprising:

an ejection orifice forming member having a liquid ejection orifice; and a substrate having a liquid flow path, wherein a liquid circulation flow path is disposed between the ejection orifice forming member and the substrate, the liquid circulation flow path includes a bubble generation chamber facing the liquid ejection orifice and is branched from the liquid flow path so as to pass through the bubble generation chamber and join the liquid flow path, the substrate has an ejection energy generation element which is arranged to face the bubble generation chamber and generates energy for ejecting liquid, in the bubble generation chamber, from the liquid ejection orifice and a circulation energy generation element which is arranged at a position, different from the position of the bubble generation chamber, to face the liquid circulation flow path and generates energy for circulating liquid in the liquid circulation flow path, the ejection energy generation element and the ejection orifice forming member are spaced from each other with a first gap and the circulation energy generation element and the ejection orifice forming member are spaced from each other with a second gap, the first gap and the second gap being different from each other, wherein the first gap (Hd) and the second gap (Hp) satisfy the relationship requirement of $1.1\times Hp<Hd$.

3. The liquid ejection head according to claim 2, wherein the ejection orifice forming member has a recess facing the liquid circulation flow path at a position located opposite to the ejection energy generation element.

4. The liquid ejection head according to claim 3, wherein at least one of end regions of the recess, with respect to the direction along the liquid circulation flow path, is tapered.

5. The liquid ejection head according to claim 2, wherein the ejection orifice forming member has a protrusion protruding into the liquid circulation flow path at a position located opposite to the circulation energy generation element.

6. The liquid ejection head according to claim 5, wherein at least one of end regions of the protrusion, with respect to the direction along the liquid circulation flow path, is tapered.

7. The liquid ejection head according to claim 2, wherein the substrate has a recess at a position facing the liquid circulation flow path and the ejection energy generation element is arranged in the recess.

8. The liquid ejection head according to claim 2, wherein the substrate has a protrusion at a position facing the liquid circulation flow path and the circulation energy generation element is arranged in the protrusion.

9. The liquid ejection head according to claim 2, wherein the ejection orifice forming member has a first recess facing the liquid circulation flow path at a position located opposite to the ejection energy generation element and the substrate has a second recess at a position facing the liquid circulation flow path, the ejection energy generation element being arranged in the second recess.

10. The liquid ejection head according to claim 2, wherein the ejection orifice forming member has a first protrusion protruding into the liquid circulation flow path at a position located opposite to the circulation energy generation element and the substrate has a second protrusion at a position facing the liquid circulation flow path, the circulation energy generation element being arranged in the second protrusion.

11. The liquid ejection head according to claim 2, wherein the ejection orifice forming member has a first recess facing the liquid circulation flow path at a position located opposite to the ejection energy generation element and the substrate has a second recess at a position facing the liquid circulation flow path, the ejection energy generation element being arranged in the second recess, and the ejection orifice forming member has a first protrusion protruding into the liquid circulation flow path at a position located opposite to the circulation energy generation element and the substrate has a second protrusion at a position facing the liquid circulation flow path, the circulation energy generation element being arranged in the second protrusion.

12. The liquid ejection head according to claim 2, wherein the ejection orifice forming member has a protrusion protruding into the liquid circulation flow path at a position located opposite to the circulation energy generation element and the substrate has a recess at a position facing the liquid circulation flow path, the ejection energy generation element being arranged in the recess, the depth of the recess being greater than the height of the protrusion.

13. A liquid ejection head comprising:

an ejection orifice forming member having a liquid ejection orifice; and a substrate having a liquid flow path, wherein a liquid circulation flow path is disposed between the ejection orifice forming member and the substrate, the liquid circulation flow path includes a bubble generation chamber facing the liquid ejection orifice and is branched from the liquid flow path so as to pass through the bubble generation chamber and join the liquid flow path, the substrate has an ejection energy generation element which is arranged to face the bubble generation chamber and generates energy for ejecting liquid, in the bubble generation chamber, from the liquid ejection orifice and a circulation energy generation element which is arranged at a position, different from the position of the bubble generation chamber, to face the liquid circulation flow path and generates energy for circulating liquid in the liquid circulation flow path, the ejection energy generation element and the ejection orifice forming member are spaced from each other with a first gap and the circulation energy generation element and the ejection orifice forming member are spaced from each other with a second gap, the first gap and the second gap being different from each other, wherein the first gap (Hd) and the second gap (Hp) satisfy the relationship requirement of $1.1 \times Hd < Hp$.

14. The liquid ejection head according to claim 13, wherein the ejection orifice forming member has a recess facing the liquid circulation flow path at a position located opposite to the ejection energy generation element.

15. The liquid ejection head according to claim 13, wherein the ejection orifice forming member has a protrusion protruding into the liquid circulation flow path at a position located opposite to the circulation energy generation element.

16. The liquid ejection head according to claim 13, wherein the substrate has a recess at a position facing the liquid circulation flow path and the circulation energy generation element is arranged in the recess.

17. The liquid ejection head according to claim 13, wherein the substrate has a protrusion at a position facing the liquid circulation flow path and the ejection energy generation element is arranged in the protrusion.

18. The liquid ejection head according to claim 13, wherein the ejection orifice forming member has a first recess facing the liquid circulation flow path at a position located opposite to the ejection energy generation element and the substrate has a second recess at a position facing the liquid circulation flow path, the ejection energy generation element being arranged in the second recess.

19. The liquid ejection head according to claim 13, wherein the ejection orifice forming member has a first protrusion protruding into the liquid circulation flow path at a position located opposite to the circulation energy generation element and the substrate has a second protrusion at a position facing the liquid circulation flow path, the circulation energy generation element being arranged in the second protrusion.

20. The liquid ejection head according to claim 13, wherein the ejection orifice forming member has a first recess facing the liquid circulation flow path at a position located opposite to the ejection energy generation element and the substrate has a second recess at a position facing the liquid circulation flow path, the ejection energy generation element being arranged in the second recess, and the ejection orifice forming member has a first protrusion protruding into the liquid circulation flow path at a position located opposite to the circulation energy generation element and the substrate has a second protrusion at a position facing the liquid circulation flow path, the circulation energy generation element being arranged in the second protrusion.

* * * * *